United States Patent [19]

Fockens

[11] Patent Number: 5,051,727

[45] Date of Patent: Sep. 24, 1991

[54] SHOPLIFTING DETECTION SYSTEM OF THE TRANSMISSION TYPE

[75] Inventor: Tallienco W. H. Fockens, Eibergen, Netherlands

[73] Assignee: N.V. Nederlandsche Apparatenfabriek Nedap, De Groenlo, Netherlands

[21] Appl. No.: 495,030

[22] Filed: Mar. 16, 1990

[30] Foreign Application Priority Data

Mar. 17, 1989 [NL] Netherlands ..... 8900658

[51] Int. Cl.[5] ..... G08B 13/18

[52] U.S. Cl. ..... 340/572

[58] Field of Search ..... 340/572

[56] References Cited

U.S. PATENT DOCUMENTS

| | | | |
|---|---|---|---|
| 4,260,990 | 4/1981 | Lichtblau | 340/572 |
| 4,274,090 | 6/1981 | Cooper | 340/572 |
| 4,308,530 | 12/1981 | Kip et al. | 340/572 |
| 4,724,426 | 2/1988 | Lundberg | 340/572 |

*Primary Examiner*—Glen R. Swann, III

*Attorney, Agent, or Firm*—Fleit, Jacobson, Cohn, Price, Holman & Stern

[57] ABSTRACT

The invention relates to a shoplifting detection system of the transmission type, suitable in particular for the use of high-frequency interrogating signals, in which system an electronic label provided with a resonance circuit can effect an electromagnetic coupling between at least two antenna coils, at least one of which is a transmitting antenna coil which, in operation, is fed with an A.C. interrogating signal from a transmitter circuit, and at least one other of which is a receiving antenna coil which supplies a received signal to a receiver circuit. According to the invention said receiver circuit comprises a phase-sensitive synchronous detector to which the received signal is supplied, and to which a reference signal is supplied of such a phase that a component in the received signal, caused by an electronic label, provides a maximum output signal of said synchronous detector, and a signal phase-shifted through 90° relatively to said component provides a minimum output signal of said synchronous detector.

14 Claims, 5 Drawing Sheets

SHOPLIFTING DETECTION SYSTEM OF THE TRANSMISSION TYPE

BACKGROUND OF THE INVENTION

The invention relates to a shoplifting detection system suitable in particular for the use of high-frequency interrogating signals, in which an electronic label can effect an electromagnatic coupling between two antenna coils, one antenna coil being a transmitting antenna coil fed with an AC interrogating signal from a transmitter circuit, and the other antenna coil being a receiving antenna coil supplying a received signal to a receiver circuit.

Such shoplifting detection systems are known in two types, which can be distinguished on the basis of operation principles, viz. the absorption principle and the transmission principle. In the system that operates according to the absorption principle one and the same antenna is connected to both a transmitter circuit, which generates a high-frequency signal, and a receiver circuit adapted to detect a change in the energy contents of the interrogating signal generated by the magnetic field.

The system operating according to the transmission principle comprises on the one hand at least one transmitting antenna coil, which is connected to a transmitter circuit and which generates an interrogating signal in a detection zone, and, on the other hand, further comprises at least one receiving antenna coil, which is connected to a receiver circuit for detecting a disturbance of the interrogation field.

In both types the electronic label comprises a resonance circuit, which will become resonant at the frequency of the interrogation field. Often the frequency of the interrogation field is periodically varied about the resonance frequency of the label. The presence of an electronic label in the interrogation field then leads to periodic pulse-shaped signals in the receiver circuit.

The invention relates to systems which are based on the transmission principle. A problem in such systems is that the interrogation field itself also generates a signal in the receiving antenna coil which is relatively strong relative to a signal caused by an electronic label. As a result, the sensitivity of such a system is relatively low.

This problem may to some extent be overcome by using antennas of particular shapes as described in, for instance, U.S. Pat. No. 4,243,980 (Lichtblau), or by arranging the transmitting antenna coil transversely to the receiving antenna coil. In practice, however, at the receiving end there is often still a signal component which is directly caused by the interrogation field and whose magnitude, moreover, is strongly dependent on the physical orientation of the antenna coils. As a result, the magnitude of this signal component is not constant, either in time or from one installation to another.

Furthermore, at high frequencies a capacitive coupling is produced, which is frequency-dependent and cannot be eliminated completely or in part in the manner described above

SUMMARY OF THE INVENTION

The invention aims to provide a shoplifting detection system in which the influence of the direct coupling between transmitting antenna coil and receiver antenna coil on the detection sensitivity is substantially eliminated. More generally, the invention aims to provide an improved, reliably operating shoplifting detection system of the transmission type. To that effect a shoplifting detection system of the type described hereinbefore is characterized, according to the invention, in that the receiver circuit comprises a phase-sensitive synchronous detector to which the received signal is supplied and to which a reference signal is supplied of such a phase that a component in the received signal, caused by an electronic label, provides a maximum output signal of the synchronous detector and a signal phase-shifted through 90° relatively to said component provides a minimum output signal of the synchronous detector.

BRIEF DESCRIPTION OF THE DRAWINGS

Hereinafter the invention will be further described by way of example, with reference to the accompanying drawings, in which FIG. 1 schematically shows an example of a detection system of the absorption type.

DESCRIPTION OF THE PREFERRED EMBODIMENTS

Figure 1:
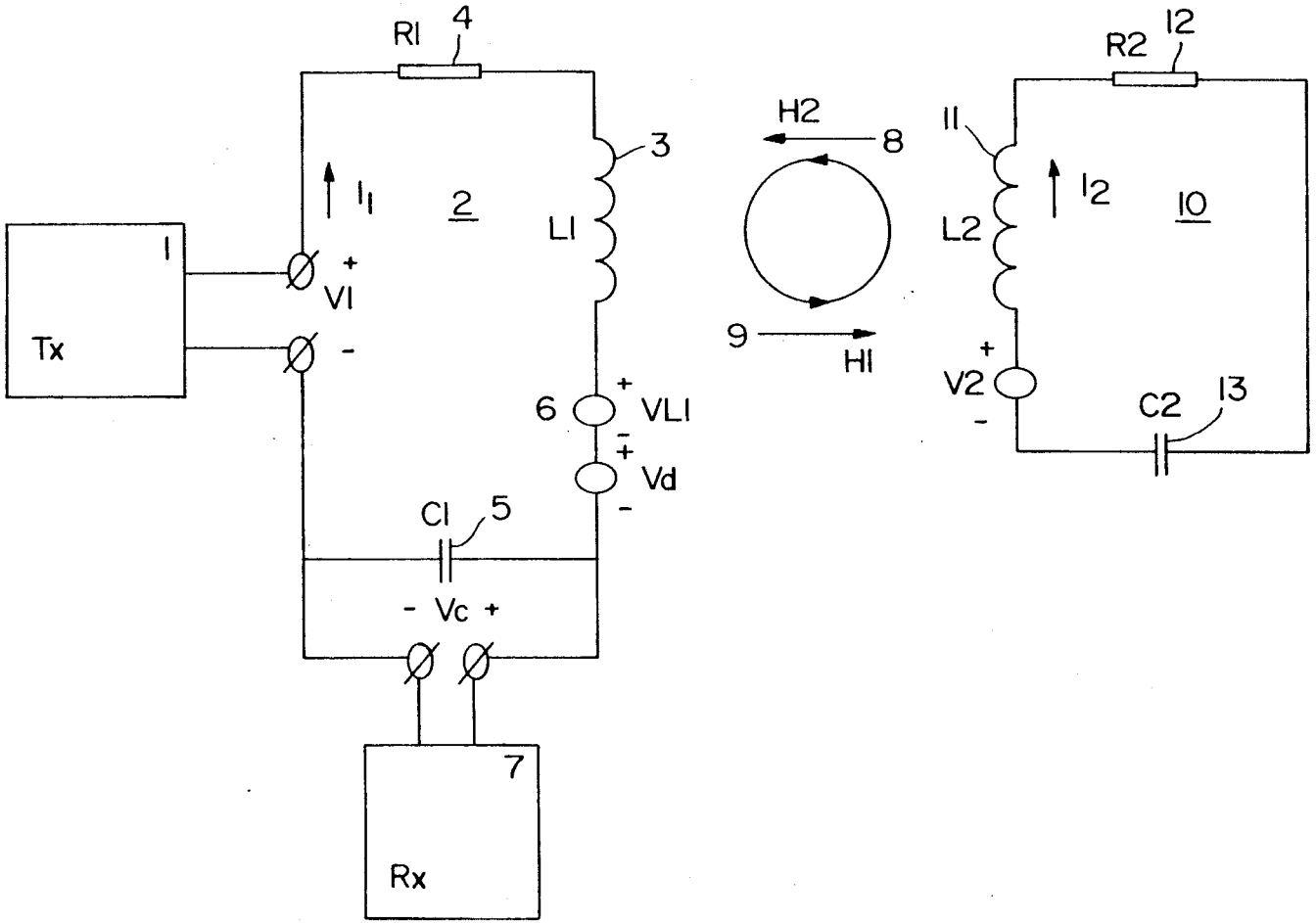

FIG. 1 illustrates the absorption principle. A transmitter circuit 1 energizes an antenna circuit 2. This circuit comprises a coil L1, designated by 3, the coil's ohmic resistance R1, designated by 4, and capacitor C1, designated by 5. The current Il through coil L1 produces a magnetic field H1, designated by 9. This is a magnetic A.C. field having the frequency of the interrogating signal generated by the transmitter circuit. Disposed in the magnetic field H1 is a label 10 with an LCR circuit provided therein comprising an air coil L2, designated by 11, with its ohmic resistance R2, designated by 12, and a capacitor C2, designated by 13 Such a label is sometimes referred to as a detection plate, responder, or wafer. The self-induction values of the coils L1 and L2 and the capacitance values of the capacitors C1 and C2 are such that both the antenna circuit 2 and the label circuit 10 will be in resonance at the frequency of the interrogating signal. The output voltage V1 of the transmitter circuit Tx causes a current I1 to flow in the serial antenna circuit R1, L1, and C1. Since the antenna circuit is in resonance, the reactive impedances of L1 and C1 cancel each other out, so that in the series connection only the real impedance of the ohmic resistance R1 remains The current I1 will be in phase with the voltage V1 The magnetic A.C. field H1, formed by the current I1 through coil L1, will also have the same phase as the current I1, and, hence, as the voltage V1. The alternating field H1 induces an induction voltage vLI in coil L1 and also an induction voltage V2 in coil L2 of the label. These voltages are in proportion to the changes in the magnetic flux through the coils in question, and hence lead by 90° in phase relative to the current I1. The voltage Vc across the condensator C1, which is equal to the voltage of the receiver circuit Rx, lags by 90° in phase relatively to the current I1, so that the phase difference between the voltages VL1 and Vc is 180°. Accordingly, except for the difference amounting to the value of V1, these voltages in the series connection cancel each other out. The voltage V2 induced in the label coil L2 produces a current I2, which, because this circuit is also in resonance, is in phase with the voltage V2, and hence leads by 90° in phase relatively to current I1. In its turn, the current I2 through the label coil L2 produces a secondary magnetic field H2. This alternating field, in phase with current I2, leads by 90° in phase relative to the primary current I1, and hence to the primary field H1. In its turn, the secondary field H2 induces a voltage Vd in the primary coil L1, which voltage then leads by 90° in phase relatively to the magnetic A.C. field H2, and hence to the voltage V2. Since the voltage V2 leads in phase relatively to the current I1, the voltage Vd will lead by 180° in phase relatively to the current I1. Thus the voltage Vd is directed oppositely to the voltage V1 at the output of the transmitter circuit Tx, and decreases the amplitude of the current I1. Apparently, then, the ohmic resistance increases in value if the label is arranged in the interrogation field. This means that the primary antenna circuit is additionally damped and the additional loss is then in fact dissipated in the ohmic resistance R2 of the label circuit. Thus the label circuit absorbs energy from the primary antenna circuit This so-called absorption phenomenon has long been known, for instance from radio transmitting/receiving technology, where a so-called "grid dip meter" can determine the resonance frequency of tuned circuits by means of inductive coupling between the circuit to be measured and an oscillator, whose power consumption strongly increases the moment energy absorption occurs, so, if the oscillation frequency equals the resonance frequency of the LC circuit to be measured. An example of a shoplifting detection system of the absorption type is described in EP-A-0 100 128.

Figure 2:
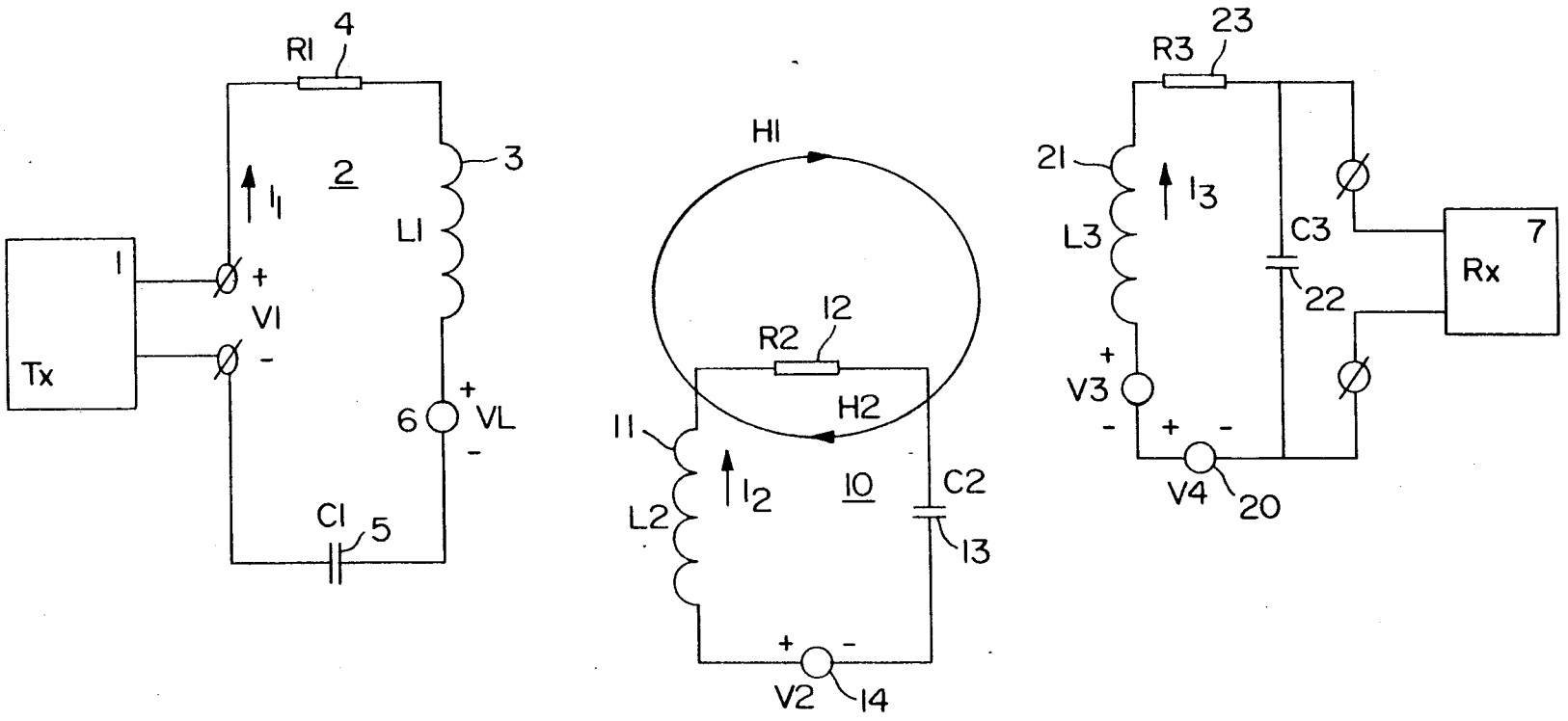
FIG. 2 schematically shows an example of a system of the transmission/type.

FIG. 2 illustrates the principle of a transmission system. The antenna circuit 2, coupled to the transmitter circuit, is the same as that in FIG. 1. The label circuit 10 is also identical, but a receiving antenna circuit 20 with a receiver circuit 7 has been added. An air coil L3, designated by 21, a capacitor C3 (22) and an ohmic resistance R3 form the antenna circuit The receiver circuit 7 is connected across the capacitor C3. The output voltage V1 of the transmitter circuit produces a current I1 in coil L1. This current forms a magnetic alternating field H1, in phase with the current I1. This field induces a voltage V3 in the receiving coil L3, which voltage leads by 90° in phase relatively to the magnetic field H1. In the same way as in the situation according to FIG. 1, an alternating current is generated in the label circuit 10, the alternating current in its turn generating a secondary magnetic A.C. field H2. Here, too, the field H2 leads by 90° in phase relatively to the primary field H1. The magnetic A.C. field H2 induces a voltage V4 in the receiving antenna coil L3. The phase of voltage V4, however, will lead by 90° in phase relatively to the voltage V3. It is essential to a proper understanding of the operation of shoplifting detection systems according to the transmission principle to realize that in systems of that type the signal contribution of the label is phase-shifted through 90° (in signal theory terms: is orthogonal to) relatively to the much stronger signal that is received directly from the transmitting coil.

Figure 3A:
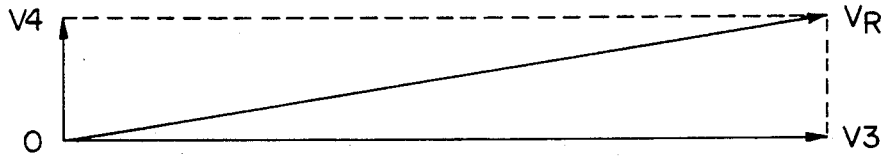
FIGS. 3*a* and 3*b* shows two vector diagrams of voltages occurring in different situations in a system according to FIG. 2.

FIG. 3*a* shows a vector diagram of the signals received in the receiving antenna, signals V3 coming directly from the transmitting antenna and signals V4 coming from the label. Voltage V3 has a relatively large amplitude, since the degree of coupling between the large-sized transmitting antenna coil and receiving antenna coil is high, in spite of the spatial separation between the two. Vr is the resultant voltage vector. It can be observed that amplitude variations in the voltage Vr as a result of variations in the voltage V4 are very small as long as voltage V4 is much smaller than voltage V3. In the known shoplifting detection systems based on the transmission principle, amplitude demodulation is applied to the voltage vr. It will be clear from the above that the signal yield will be very small if amplitude demodulation is applied to a system in which the transmitting and receiving antennas used are two simple O-shaped coils. Accordingly, often a different antenna configuration is used, in which one antenna coil has the shape of the letter O and the other has the shape of the figure eight The antenna coil in the shape of an eight really consists of two co-planar coils which are connected in opposite phases. The two coils may have a common branch. The terms sometimes used are "planar single (rectangular) loop antenna" and "planar multiple (rectangular) twisted loop antenna". The result of the figure-eight pattern is that a homogeneous magnetic field extending in the same direction through both coil halves induces in both coil parts voltages of the same amplitude and opposite phase, so that the sum of the two voltages is zero.

Figure 4:
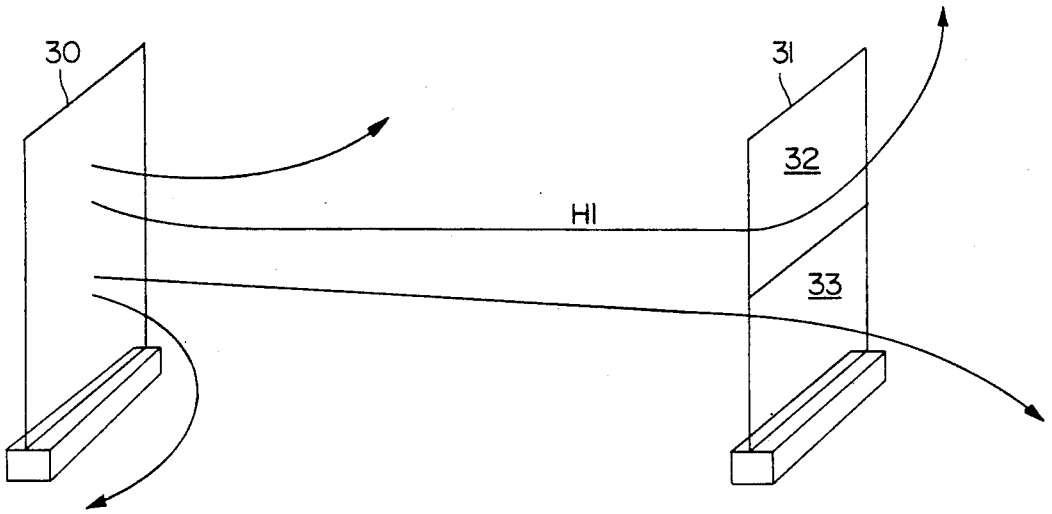
FIG. 4 schematically shows a specific antenna configuration.

FIG. 4 shows such a configuration as it is often used in practice. An O-shaped antenna 30 is generally connected to the transmitter circuit, as shown, and generates a magnetic A.C. field H1. It is true this field is not homogeneous, but an equal flux passes through the two loops 32, 33 of an 8-shaped receiving coil 31 on account of the 8-shaped receiving coil 31 being arranged parallel to the transmitting coil 30 in such a way that the axis of coil 30 coincides with the axis of coil 31. The result is that in this configuration the interrogation field induces hardly any voltage, if at all, in the receiving coil 31. Conversely, a field generated by an 8-shaped coil does not induce any voltage in an O-shaped coil either, since the separate part fluxes from the two parts of the 8-form cancel each other out in the plane of the O-shaped coil. The combination of an O-shaped transmitting coil and an 8-shaped receiving coil is preferred because when the 8-shaped antenna coil is used as a receiving coil, interfering signals from outside the system, such as radio signals, mains interference, etc., are also eliminated.

Figure 3B:
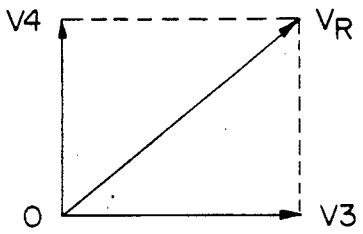

If in the manner described above the direct coupling between the transmitting antenna and the receiving antenna is minimized, the voltage V3 in the vector diagram will also become small, as shown in FIG. 3*b*. On account of this, the resultant voltage Vr is much more strongly dependent on the voltage V4. Thus the sensitivity of these shoplifting detection systems depends on the extent to which the elimination of the voltage V3 is successful.

Another technical problem that presents itself in these systems is the following. At the typical high working frequencies (e.g. 8.2 MHz) the antenna parts carry a high-frequency voltage, and so do the shielding tubes for the antenna parts if shielded coils are used. As a result, a capacitive coupling is produced which is strongly frequency-dependent. The voltage components in the receiving antenna which result from this add up vectorially to the voltage V3. The total sum of the voltages induced in the receiver circuit, therefore, is strongly frequency-dependent. If the transmitting frequency is varied now, as is usually done in this type of shoplifting detection systems, it may happen that within the frequency sweep there is a frequency where the elimination of the voltage induced directly by the transmitting antenna is perfect and where a leap in phase of 180° occurs. This signifies a sharp minimum in the amplitude values of the voltage V3 as a function of time, which during the further signal processing yields a signal pulse which cannot be distinguished anymore from a pulse coming from a label. In particular, if the field between the transmitting and receiving antennas is disturbed, for instance by a metal shopping trolley, or even a human body, the result may be a false alarm In the present invention the abovementioned problems associated with shoplifting detection systems of the transmission type are solved by means of a different way of demodulating the signal that is received by the receiver circuit from the receiving antenna. It is known from FIG. 3*a* that the voltage V4 must be detected in the presence of a much stronger voltage V3. In accordance with the invention synchronous detection is used for that purpose.

Figure 5:
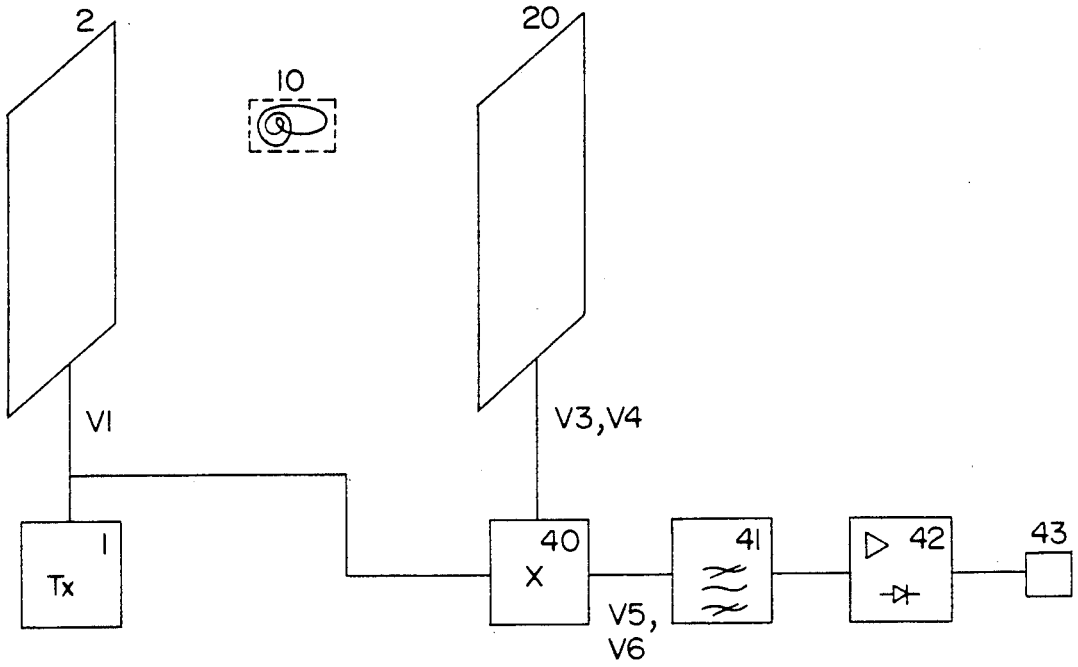
FIG. 5 schematically shows an example of a shoplifting detection system according to the invention.

FIG. 5 shows a block diagram of an example of a shoplifting detection system of the transmission type, in which synchronous detection is used. The transmitting circuit 1 generates a high frequency interrogating signal $V1 = a \times \sin(2\pi f)$, which transmitting antenna 2 uses to generate a magnetic A.C. field. This field induces in receiving antenna 20 a voltage $V3 = b \times \cos(2\pi f) = b \times \sin(2\pi f + \pi/2)$, so leading by 90° in phase relatively to voltage V1. The voltage V1, or a voltage derived from it, is, as a reference voltage, also supplied to the product detector 40, in which the voltage V3 coming from the receiving antenna is multiplied by the voltage V1 by analog computation. The product is the voltage $$\begin{aligned} V5 &= V1 * V3 = a * \cos(2\pi f) * b * \sin(2\pi f) \\ &= a * b * [\sin(2\pi f - 2\pi f) + \sin(2\pi f + 2\pi f)] \end{aligned}$$

Thus, the voltage V5 is composed of a D.C. voltage component and a component having the double frequency In a band pass filter 41 this double frequency component is filtered out, and accordingly it can be disregarded for the rest of this exposition. Since $\sin(0) = 0$ the D.C. voltage component is zero, so that the output signal is zero. If there is a label in the field H1, the receiving antenna coil will also supply a voltage $$\begin{aligned} V4 &= c * \sin(2\pi f + \pi/2) \\ &= -c * \cos(2\pi f) \end{aligned}$$

to the product detector 40. The output voltage as a result of V4 will then be $$\begin{aligned} V6 &= a * \sin(2\pi f) * (-c * \sin(2\pi f + \pi/2) \\ &= a * c * [\sin(2\pi f - 2\pi f - \pi/2) + \sin(2\pi f + 2\pi f + \pi/2)] \\ &= -a * c * (\sin(-\pi/2) + \sin(4\pi f + \pi/2)) \\ &= a * c * 1 - a * c * \sin(4\pi f + \pi/2). \end{aligned}$$

Here, too, the double frequency component may further be left out of consideration, so that only the D.C. voltage term $a \times c$ remains. The total output voltage of the product detector 40 is the sum of V5 and V6 and amounts to $a \times c$. The voltage V3 does not play a role anymore. In a practical embodiment, however, the phase difference between V1 and V3 will not be exactly 90°. As a result, still a part of the product of V1 and V3 will come out at the output of the product detector. It can easily be derived that this component will have a magnitude of $$V5 = a \times b \times \sin(\theta),$$

wherein $\theta$ is the phase deviation of 90°.

Figure 6A:
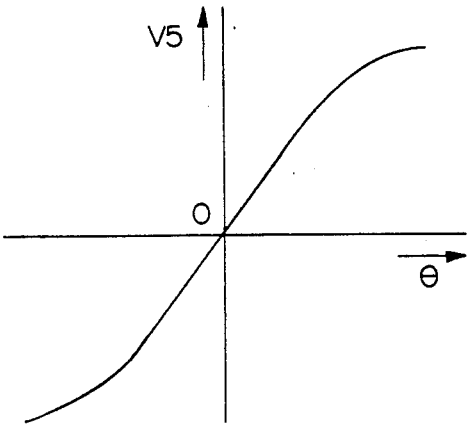
FIGS. 6*a* and 6*b* show two diagrams relating to a voltage occurring in a system according to FIG. 5.

FIG. 6*a* graphically shows how V5 depends on $\theta$. It is essential that both the function V5 ($\theta$) itself and the first derivative (directional coefficient) is continuous in $\theta = 0$.

Figure 6B:
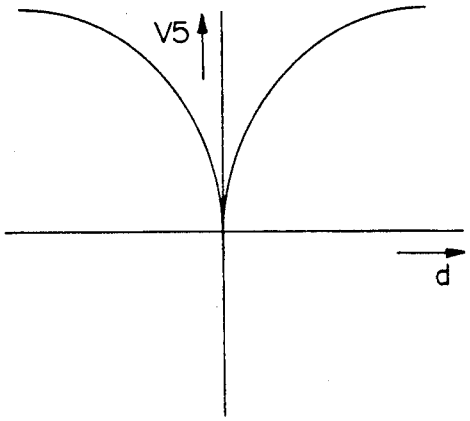

FIG. 6*b*, for the purpose of comparison, shows the output voltage V5 of an amplitude detector in combination with an O-shaped and 8-shaped antenna combination, as is conventionally used in shoplifting detection systems of the transmission type in accordance with the present state of the art. Along the horizontal axis the symmetry is plotted which obtains in the combination of the magnetic interrogation field and the 8-shaped antenna. The symmetry factor $$d = |V32 - V33| / (V32 + V33)$$

is zero for perfect symmetry. V32 and V33 are the voltages generated in the different loops of an 8-shaped antenna 31, see FIG. 4 In the function V5(d) the first derivative (the directional coefficient) is discontinuous for $d = 0$. This means that frequency-dependency in the symmetry upon frequency-sweeping the interrogation field, leads to a sharp signal pulse at the output of the amplitude detector when the point $d = 0$ is passed. In the subsequent signal processing, this pulse cannot be distinguished anymore from a pulse produced by a label. It will be clear from FIG. 6*a* that in the same situation in a shoplifting detection system according to the invention no sharp pulse will occur at the output of the product detector.

A band pass filter 41 serves to restrict the frequency spectrum of the output signal of the product detector 40 to a frequency band between a frequency f1 and a frequency f2. The lower limit f1 is determined by the wobble frequency of the high-frequency interrogation frequency. As noted before, the phase difference between V1 and V3 is slightly frequency-dependent. The amplitudes of V1 and V3 exhibit a dependency on the instantaneous interrogation frequency As a result, the output voltage of the product detector will produce an output signal V5 which in the absence of the label is not completely zero, but contains frequency components of the wobble frequency and some higher harmonics thereof. In a practical embodiment the wobble frequency is of the order of 140 Hz, while the lower limit of the band pass filter is of the order of 2 Hz. The signal of the label, as it comes out at the output of the product detector 40 contains spectral components from O to circa 15 kHz.

Figure 8:
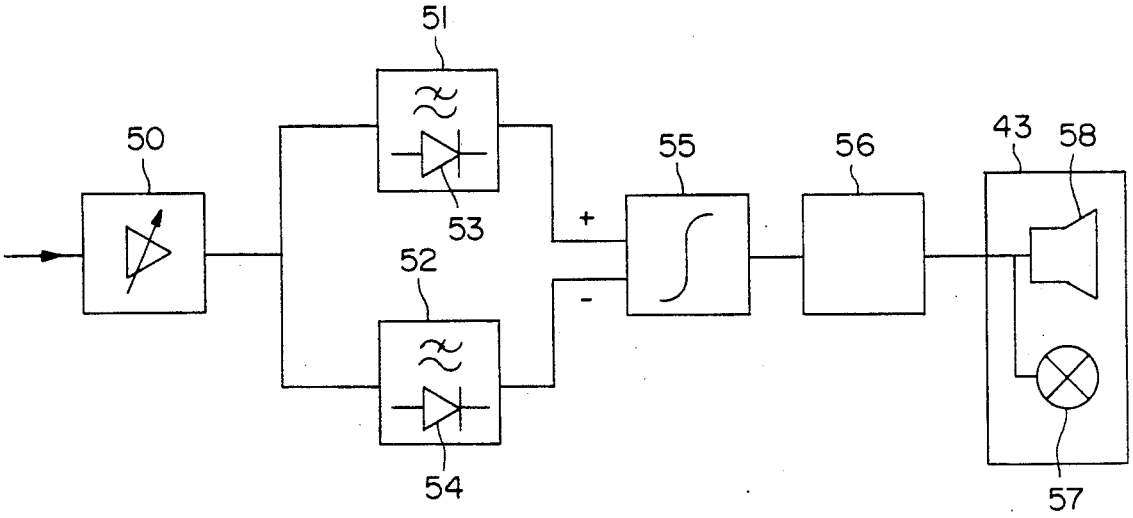
FIG. 8 shows an example of a signal processing unit suitable for use in a detection system according to the invention.

The part of that spectrum from 2 to 15 kHz will then be allowed to pass and is further processed in the amplifying and signal processing unit 42. The upper limit of the band pass filter may for instance be in the vicinity of 50 kHz. This means that noise and other interfering signals which have spectral components in the range of 15–50 kHz as well as in the range of 2–15 kHz, are also amplified and further processed in the amplifying and processing unit 42. The above-described spectral distribution of the label signal and the interfering signals, including noise, makes it possible to reliably detect a label signal without false alarms using an amplifying and signal processing unit 42. An example of a suitable signal processing unit is described in European Patent No. 0,100,128, which is incorporated herein by reference. Such an apparatus may operate analogously as well as digitally Accordingly, the signal processing unit may in a similar way comprise a discriminator filter device which separates detection signals from interfering signals. FIG. 8 schematically shows in greater detail an example of such a signal processing unit 42. The signal processing unit shown comprises an amplifying stage, adjustable if desired, whose output is connected to a low-pass filter 51 and a high-pass filter 52 connected in parallel to it. The low-pass filter allows the signals in the frequency band from 2 to 15 kHz to pass. The label detection signals are in this band. The high-pass filter allows signals in the frequency band of 15 to 50 kHz to pass These are interfering signals. Further, both filters are rectified, as schematically shown at 53 and 54 The rectified output signals of the filters are supplied to the inputs of an integration circuit 55 with a positive and a negative input. The output signals of the low-pass filter 51 are supplied to the positive input of the integration circuit and cause the output voltage of the integration circuit to increase. The output signals of the high-pass filter are supplied to the negative input of the integration circuit and cause the output voltage thereof to decrease. Preferably the integration circuit is adjusted so that the output voltage also decreases if to both inputs a signal is supplied. The output of the integration circuit is connected to a comparator circuit 56, which produces an output signal as soon as the output voltage of the integration circuit exceeds a pre-determined threshold value. The output of the comparator circuit 56 is connected to a signaling apparatus 43, which may for instance comprise one or more signalling lamps 57 or an acoustic signalling means 58.

In the above description of a shoplifting detection system according to the invention it was assumed to comprise an O-shaped transmitting and an O-shaped receiving antenna. However, the invention can also be used with 8-shaped antennas for transmitting as well as receiving purposes. In this configuration there is no elimination of induced voltages, but, on the other hand, the coupling between the transmitting and the receiving antennas is weaker than in the case of two O-shaped antennas It is more important, however, that a homogeneous magnetic A.C. field such as is produced when a radio wave hits the antenna, or when local disturbing fields enclose the 8-shaped receiving antenna, hardly, if at all, gives voltage to the terminals of the antenna. Conversely, an 8-shaped transmitting coil gives little, if any, magnetic field sensitivity at a great distance from the antenna, since the part-fields of the parts of the 8-shape are oppositely directed so that they quench one another at distances greater than the size of the antenna. These last two properties mean that the working area of 8-shaped antennas is strongly limited to an area around the antenna, of a magnitude of the order of the largest measurements of the antenna itself. Thus the radio interference limits, such as they are applied in various countries, can easily be met. Mutual interference between shoplifting detection systems with the same working frequency, of the same make or of different make, is also strongly reduced in this way. This means that when the detection system is used in chain stores with more than one exit, the installations at the respective exits do not have to be synchronized with one another, which also means a considerable reduction of installation expenses. As a result, also the reliability of the installation as a whole increases.

Figure 7:
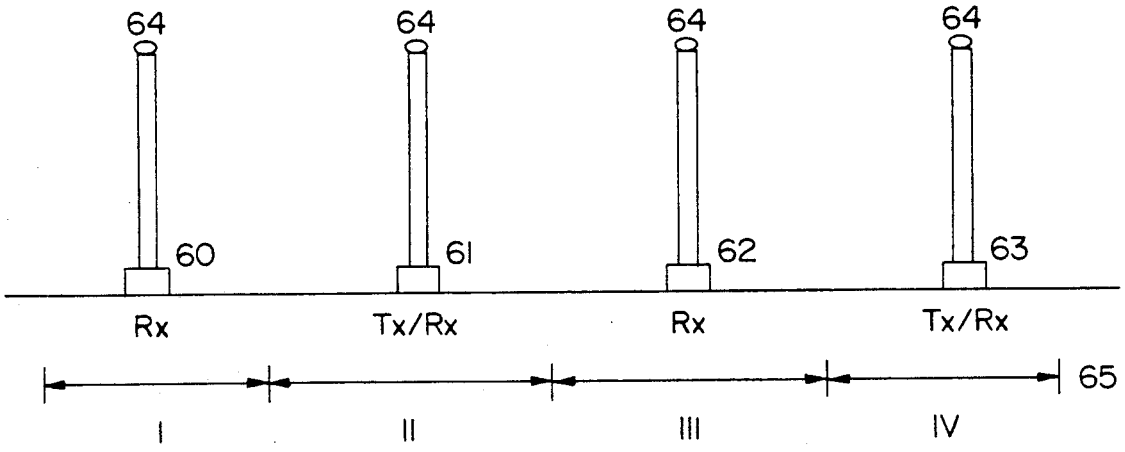
FIG. 7 illustrates a special embodiment of a system according to the invention.

A further elaboration of the invention concerns the possibility of combining the absorption principle and the transmission principle in one shoplifting detection installation For that purpose the transmitter circuit Tx and the transmitting antenna 2 of a transmission system are replaced with the transmitter circuit and transmitting/receiving antenna of a detection system according to the absorption principle as shown in FIG. 1. The fact that a detection pillar for an absorption system also comprises a receiver circuit is not relevant to the operation of the adjacent receiver pillar of a transmission system. FIG. 7 shows an example of such a hybrid installation. Detection pillars 60, 62 operating as receiver pillars in a transmission system are designated by Rx and the transmitter/receiver pillars 61, 63 from the absorption system are designated by Tx/Rx. In the hybrid system shown in FIG. 7 the two types are arranged alternately. All pillars in this system operate as receiver pillars and comprise a detection circuit according to FIG. 5 or EP-A-0100128. The pillars 61 and 63 (the absorption pillars) also operate as transmitter pillars. At the top of the pillars signalling lamps 64 are provided. These lamps will light up when the pillar in question has detected a label. In this row only one pillar can signal, since an interlocking circuit is present, which deactivates all other pillars as soon as a pillar signals. If a label is passed through the center of a passageway between two pillars, due to the interlocking circuit, the pillar which is the first to detect the label with certainty, will signal In the shoplifting detection systems of the transmission type according to the known state of the art it was necessary to activate transmitter pillars in turn to obtain selective signalling for each passageway Since thus only a limited detection time per passageway is available for a receiver pillar to detect a label, the eventual result is a limitation of the detection sensitivity.

A further advantage of this hybrid array will become clear when the sensitivity areas 55 are considered further. The sensitivity area of an absorption pillar 51, 53 is always symmetrical about the pillar. See FIG. 7, the sensitivity areas II and IV. A receiver pillar, however, will only receive a label signal if the label is in a transmitter field. This means that receiver pillar 51 can only receive a label signal when a label passes through the transmitter field of absorption pillar 51. In FIG. 7 in the area to the left of pillar 50 there is no transmitter field present anymore. Accordingly, a label that passes through that area will not cause an alarm. This property is important when pillar 50 is the end pillar in a row of pillars arranged before an exit. To the left of this pillar there is often selling space where goods may be arranged that are protected by electronic labels In a row of absorption pillars only, in accordance with the state of the art, there is an area where labels can be detected outside the row of detection pillars, adjacent to the end pillars. Similarly, in FIG. 7 sensitivity area IV extends also to the right of end pillar 53. In the combination of transmitter/receiver pillars according to the absorption principle and receiver pillars according to the transmission principle, the so-called hybrid system, it is thus possible to restrict the sensitivity areas on opposite sides of a row of pillars.

It is observed that after reading the above various modifications will readily occur to one skilled in the art without departing from the scope of the invention. Accordingly, such modifications are held to fall within the scope of the invention.

I claim:

1. A shoplifting detection system of the transmission type, suitable in particular for the use of high frequency interrogating signals, in which system an electronic label provided with a resonance circuit can effect an electromagnetic coupling between at least two antenna coils, at least one of which is a transmitting antenna coil which, in operation, is fed with an A.C interrogating signal from a transmitter circuit, and at least one other of which is a receiving antenna coil which supplies a received signal to a receiver circuit, characterized in that said receiver circuit comprises a phase-sensitive synchronous detector to which the received signal is supplied, and to which a reference signal is supplied of such a phase that a component in the received signal, caused by an electronic label, provides a maximum output signal of said synchronous detector, and a signal phase-shifted through 90° relatively to said component provides a minimum output signal of said synchronous detector.

2. A shoplifting detection system as claimed in claim 1, characterized in that the reference signal is the interrogating signal or a signal directly derived from said interrogating signal.

3. A shoplifting detection system as claimed in claim 1, characterized in that said synchronous detector comprises a product detector which multiplies the received signal by the reference signal by analog computation.

4. A shoplifting detection system as claimed in claim 1, characterized by a band pass filter connected to the output of the synchronous detector.

5. A shoplifting detection system as claimed in claim 1, characterized in that both said at least one transmitting antenna coil and said at least one receiving antenna coil are eight-shaped.

6. A shoplifting detection system as claimed in claim 1, characterized in that said at least one transmitting antenna coil is connected to a receiver circuit of a detection system of the absorption type.

7. A shoplifting detection system as claimed in claim 6, comprising a plurality of detection pillars disposed in a row and each containing at least one transmitting antenna coil or a receiving antenna coil to form a detection zone between each pair of adjacent detection pillars, characterized in that of the detection pillars defining a detection zone, one comprises a receiving antenna coil connected to a receiver circuit for a shoplifting detection system of the transmission type as claimed in claim 1, and the other comprises a transmitting antenna coil connected to a transmitter/receiver circuit of a shoplifting detection system of the absorption type.

8. A shoplifting detection system as claimed in claim 7, characterized in that, viewed lengthwise of the row, the detection pillars with a receiving coil for a shoplifting detection system of the transmission type alternate with the detection pillars with a transmitting coil for a system cf the absorption type.

9. A shoplifting detection system as claimed in claim 8, characterized in that the detection pillar on at least ore end of the row of detection pillars is one with a receiving coil for a shoplifting detection system of the transmission type.

10. A. shoplifting detection system as claimed in claim 7, characterized by a blocking device which, in response to a label detection signal generated by one of the detection pillars, prevents the other detection pillars from generating a label detection signal.

11. A shoplifting detection system as claimed in claim 10, characterized in that each detection pillar is provided with a signalling lamp.

12. A shoplifting detection system as claimed in claim 1, characterized in that the receiver circuit connected to a receiving antenna coil comprises a discriminator filter device connected to the output of the band pass filter, and including a low-pass filter permitting the passage of signals in such a first frequency band that these signals may be caused by an electronic label, and including a high-pass filter permitting the passage of signals within the frequency range allowed to pass the band pass filter, but outside said first frequency band.

13. A shoplifting detection system as claimed in claim 12, characterized in that said discriminator filter device comprises an integration circuit with a positive and a negative input, the low-pass filter being connected to the positive input, and the high-pass filter to the negative input.

14. A shoplifting detection system as claimed in claim 13, characterized in that the integration circuit is connected to a comparator circuit which provides an output signal when the output voltage of the integration circuit exceeds a predetermined threshold value.

* * * * *